US010711457B2

(12) United States Patent
Torrabias Cantal

(10) Patent No.: US 10,711,457 B2
(45) Date of Patent: Jul. 14, 2020

(54) STRUCTURAL ELEMENT FOR SECURING GLASS PARTITIONS

(71) Applicant: Oscar Torrabias Cantal, Barcelona (ES)

(72) Inventor: Oscar Torrabias Cantal, Barcelona (ES)

( * ) Notice: Subject to any disclaimer, the term of this patent is extended or adjusted under 35 U.S.C. 154(b) by 0 days.

(21) Appl. No.: 16/302,985

(22) PCT Filed: Apr. 27, 2017

(86) PCT No.: PCT/ES2017/070260
§ 371 (c)(1),
(2) Date: Nov. 19, 2018

(87) PCT Pub. No.: WO2018/015585
PCT Pub. Date: Jan. 25, 2018

(65) Prior Publication Data

US 2019/0292777 A1 Sep. 26, 2019

(30) Foreign Application Priority Data

Jul. 21, 2016 (ES) ..... 201630991

(51) Int. Cl.
*E06B 3/58* (2006.01)
*E06B 3/54* (2006.01)
(Continued)

(52) U.S. Cl.
CPC ..... *E04B 2/7453* (2013.01); *E04B 2/74* (2013.01); *E06B 3/58* (2013.01); *E06B 3/5807* (2013.01);
(Continued)

(58) Field of Classification Search
CPC ..... E06B 1/40; E06B 3/5807; E06B 3/5878; E06B 3/5409; E06B 3/5454; E06B 3/62;
(Continued)

(56) References Cited

U.S. PATENT DOCUMENTS 2,228,358 A * 1/1941 Lowry ..... E06B 3/2605 52/204.591
2,667,951 A * 2/1954 Gall ..... E06B 3/62 52/204.595
(Continued)

FOREIGN PATENT DOCUMENTS

DE 2614803 10/1977
EP 2743438 6/2014
(Continued)

OTHER PUBLICATIONS

International Search Report, PCT/ES2017/070260, dated Jul. 25, 2017.

*Primary Examiner* — Kyle J. Walraed-Sullivan
(74) *Attorney, Agent, or Firm* — DeFillo & Associates, Inc.; Evelyn A. DeFillo

(57) ABSTRACT

Disclosed is a structural element for securing glass screens, which is formed by: a metal support profile in which is located a seating zone of the glass, the end of the profile including a vertical rib preceded by a rectangular groove and a second V groove; a closing metal profile including an L-shaped protrusion that can be coupled to the vertical rib, the end of the projection being inserted into the rectangular groove and a V rib that sits in the V groove; and an elastic profile in T whose having a vertical section formed by two or more parallel walls through which pass two or more inclined planes that protrude through the sides.

5 Claims, 4 Drawing Sheets

(51) Int. Cl.
*E04B 2/74* (2006.01)
*E06B 3/62* (2006.01)

(52) U.S. Cl.
CPC .... *E06B 3/5878* (2013.01); *E06B 2003/6217* (2013.01)

(58) Field of Classification Search
CPC ..... E06B 3/6267; E06B 3/5821; E06B 3/549; E06B 2003/6217; E06B 2003/6223; E06B 2003/6258; E06B 2003/6244; E04B 2/7435; E04B 2/745; E04B 2/7455; E04B 2/7462
USPC ... 52/204.62, 204.64, 204.65, 204.69, 204.7, 52/204.71, 204.591
See application file for complete search history.

(56) References Cited

U.S. PATENT DOCUMENTS 3,155,205 A * 11/1964 Piace ..... E06B 3/5821 52/204.591
3,918,231 A * 11/1975 Kessler ..... E06B 3/305 52/844
3,981,118 A * 9/1976 Johnson ..... B66B 23/24 52/716.8
4,006,569 A * 2/1977 Kain ..... E06B 3/5454 52/204.591
4,267,673 A * 5/1981 Coulston ..... E06B 1/325 428/57
4,612,743 A * 9/1986 Salzer ..... E06B 3/28 49/501
5,379,518 A * 1/1995 Hopper ..... E06B 3/22 29/415
5,557,899 A * 9/1996 Dube ..... E06B 3/221 49/DIG. 2
5,768,837 A * 6/1998 Sjoholm ..... E06B 3/305 52/204.62
6,419,209 B1 * 7/2002 Shepherd ..... E04F 11/1853 256/24
6,817,144 B1 * 11/2004 Tavivian ..... A47K 3/30 4/607
8,042,316 B2 * 10/2011 Lee ..... E06B 3/5892 52/204.71
9,683,402 B2 * 6/2017 Abdul Lathief .... E06B 3/66304
2003/0070371 A1 * 4/2003 Kobrehel ..... B60J 1/2094 52/204.5
2004/0231255 A1 * 11/2004 Silverman ..... E06B 3/24 52/204.6
2006/0185273 A1 * 8/2006 Lathief ..... E06B 3/5821 52/204.71
2009/0031653 A1 * 2/2009 Nash ..... E04F 11/1851 52/238.1
2009/0113826 A1 5/2009 Lathief
2010/0083597 A1 * 4/2010 Addison ..... E06B 3/303 52/204.53
2010/0266800 A1 * 10/2010 Dutsch ..... E06B 3/5454 428/40.4
2011/0030295 A1 * 2/2011 Morley ..... E06B 3/549 52/204.7
2012/0189378 A1 * 7/2012 Visa ..... E04F 11/1853 403/267
2013/0340308 A1 * 12/2013 Fette ..... G09F 7/18 40/594
2016/0298375 A1 * 10/2016 Wagner ..... E06B 3/5454
2017/0167185 A1 * 6/2017 Boer ..... E06B 1/18
2019/0301233 A1 * 10/2019 Zucker ..... E06B 3/5454

FOREIGN PATENT DOCUMENTS

ES 2592809 12/2016
GB 2202260 9/1988
GB 2218448 11/1989
NL 6704260 9/1968

* cited by examiner

STRUCTURAL ELEMENT FOR SECURING GLASS PARTITIONS

TECHNICAL SECTOR

The invention relates to a structural element for the installation of glass partitions as dividing elements of workspaces or in the home, whose configuration guarantees the placement of the glass during the installation operation, without the risk of occurring deformations of the glass seating area that prevent or hinder the final assembly of the device.

STATE OF ART

The glass partitions are highly valued solutions for the division of work spaces, because they give the interior of the place a great amplitude and luminosity, and a minimalist effect that allows designers and architects to develop their proposals in a more advantageous way.

The glass partition is placed in a frame that acts as an intermediary between the walls and floor of the room and the dividing glass.

Operationally, the placement of a glass partition first involves fixing the frame to the walls and floor of the room, and once the frame is fixed, the incorporation of glass wall into it. For this reason, the frames have a general configuration in U, placing the glass inside and resting its weight on the stretch of frame located on the floor. It must be said that the weight of these glass partitions is very high, normally above 100 kg, although it can be much higher in special pieces of large dimensions.

To incorporate or insert the glass inside the frame, it is necessary to provide a space through which it can enter, and which can be closed once it has been placed. For this reason, the U-frame is constituted by two parts:

- a seat element which is fixed to the wall and which is open on one of its sides to allow the entrance of the glass.
- a closing element, which engages on the seat element and closes the space through which the glass enters, definitively fixing its position.

Generally the union of these two elements is carried out according to a system of tongue-and-groove, so that the closure element (male) is inserted into a space provided under the seat area of the glass (female).

In the patent US20090113826A1, which describes a system for placing glass partitions comprising two profiles of aluminum, one male and other female between which the glass is placed, where in the female profile have a seating area of the glass formed by a cantilever protruding from its vertical wall below which the male part of the second profile is inserted.

This configuration has the disadvantage that when the glass rests on the cantilever constituting the seating area during assembly, the cantilever tends to bend under its weight, making it impossible or very difficult to insert the male element.

This is because, in this position, the seating area of the glass is horizontal so, that the entire weight of the glass falls on an eave without any support. Secondly, if it has been possible to introduce the male element, the disassembly of the system is impossible, since the weight of the glass itself prevents the output of the male element.

DE2614803A1 describes an analogous system, in which the female profile also incorporates a seating area of the glass, under which the male element is inserted, whereby the same problem occurs again.

On the other hand, the placement of the glass on the seating area of the metal profile is always carried out with the intermediation of an elastic strip that prevents the glass from coming into contact with the metal and splintering it. This elastic strip has no mechanical fixation, so it usually gives problems at the time of placement of the glass, it is easy that the strip moves or wrinkles during the operation of inserting the glass.

EXPLANATION OF THE INVENTION

The object of the present invention is a structural element for fixing glass partitions and separations in work spaces or in the home, which has an alternative coupling configuration to the male-female system, so that the seating area of the glass. It supports directly against the floor of the room, definitively solving the problems of deformation during the incorporation of the glass.

To do this, the new structure consists of three elements, two metal profiles, one open on which the glass rests and another that closes the opening of the first through which the glass is inserted and an elastic profile that immobilizes the whole exerting a force on the previous ones that guarantees its perfect fit and interlocking.

In particular, the support metal profile of the glass has a structure with an L-shaped general section in which the horizontal section, which constitutes the seating area of the glass, is thicker than the vertical section and has a vertical rib preceded by a groove of rectangular section and small depth. It also has a second groove with a V-section located in the lower area of the lateral face of this horizontal section. The vertical section has a groove with a T-section in which a rubber gasket of separation of the glass is coupled. It also incorporates an elastic strip along the glass seating area. These elements are usually used to avoid direct contact of the glass with the metal of the frame.

The closing metal profile has a structure with a rectangular general section, on one of whose sides there is provided, on the one hand, an L-shaped protrusion which couples on the vertical rib of the support metal profile with sufficient clearance to pivot on this and whose end is inserted in the groove of rectangular section adjacent to said rib, and on the other hand, a rib with a V-section arranged laterally at the end of the piece and which is locked in the groove with section V of the support metal profile.

The elastic profile has a section with a general configuration in T, where the vertical section is constituted by two or more parallel walls crossed by two or more inclined planes protruding from the sides. This profile is introduced under pressure, closing the gap between the glass and the closing metal profile, exerting on the closing metal profile, a force towards the outside resulting from the compression of the central core of the vertical section of the T and from the bending of the protrusions of the inclined planes, which make pivot the closing profile on the coupling to the support profile, forcing the locking of the V-rib in the V-groove of the support profile, so that both metal profiles are secured without the possibility of being separated by accident.

To disassemble the glass partition, it is enough to extract elastic profile in T from its position in the gap between the glass and the closing profile, allowing the closing profile to pivot on the rib of the support profile with which the V-rib is unlocked leaving the closing profile and the support profile released effortlessly and without the weight of the crystal affect in the operation.

This configuration of the elastic profile in T allows the use in different thicknesses of glass in the claimed device, only using an elastic profile of appropriate width.

Another new aspect of the invention is that it comprises a second elastic profile with an L-section, which replaces the rubber gasket and the elastic separation strip of the glass. This profile covers the entire interior of the support profile and is mechanically coupled to it by means of a rib with a T-section that engages the T-groove of the support profile. This profile has the advantage of facilitating the placement of the glass since the separating element that covers the seating area of the glass is mechanically attached to the support profile, thereby avoiding accidental displacements during the assembly of the glass partition. On the other hand, this mechanical fixation does not prevent manually raising the elastic profile to insert the fixing screws of the frame to the ground.

DESCRIPTION OF THE DRAWINGS

In order to illustrate what has hitherto been explained, this specification is accompanied by a set of drawings that are only illustrative and not limiting of the practical possibilities of the invention.

In said drawings.

REFERENCE LIST

Figure 1:
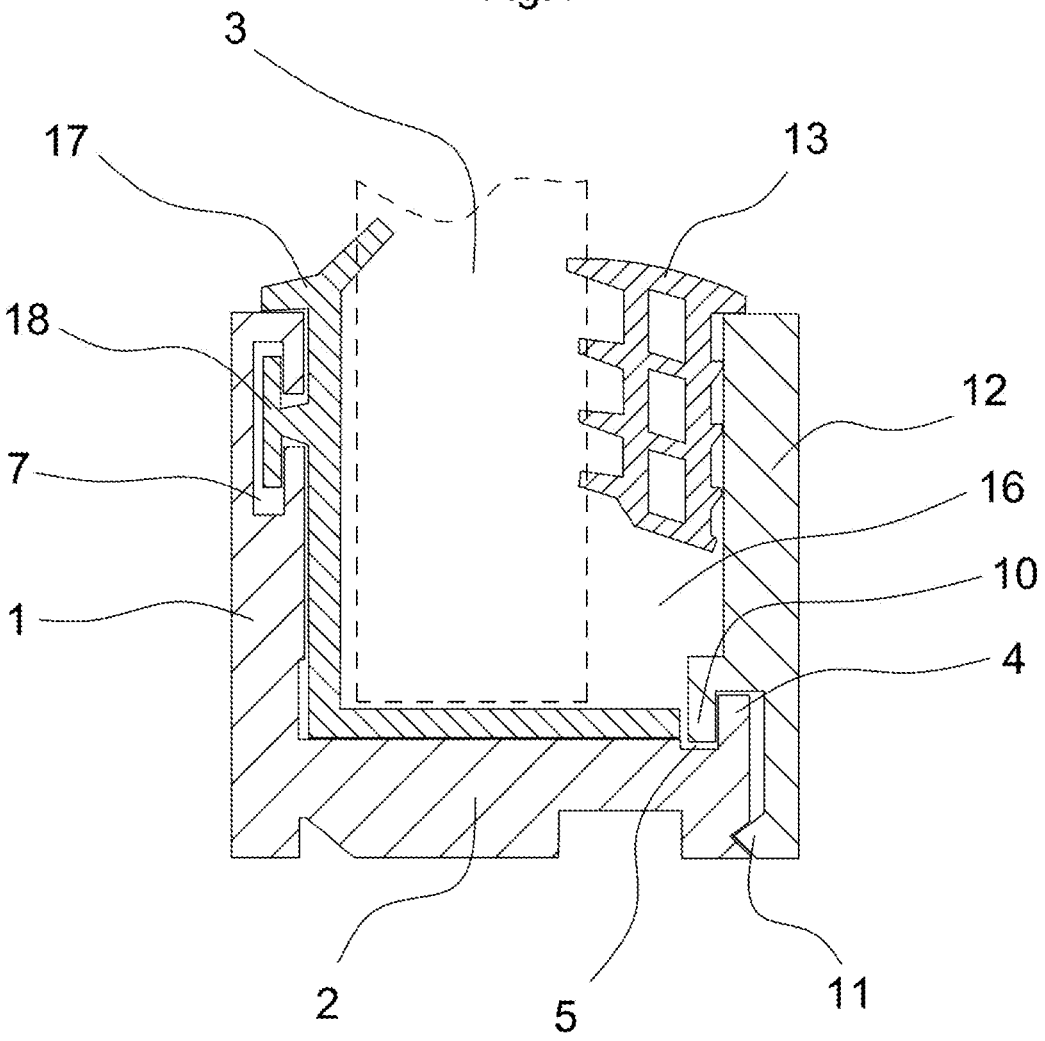
FIG. 1 corresponds to a sectional view of the new structural element for securing glass partitions.
Figure 2:
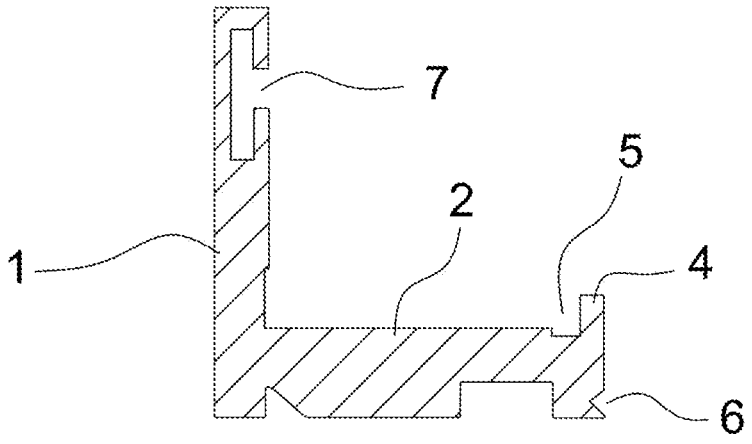
FIG. 2 corresponds to a sectional view of the support metal profile.
Figure 3:
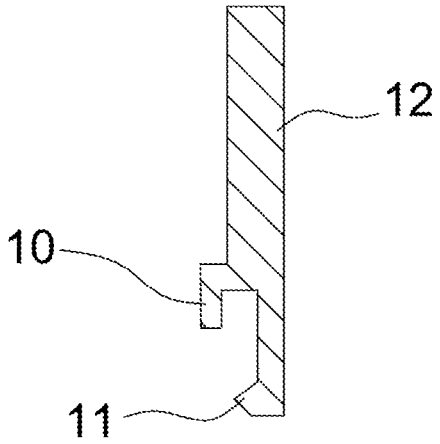
FIG. 3 corresponds to a sectional view of the closing metal profile.
Figure 4:
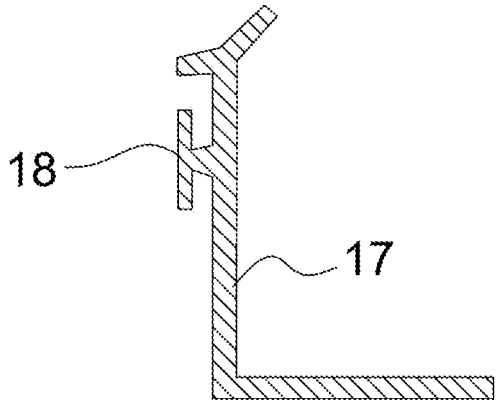
FIG. 4 corresponds to a sectional view of the elastic profile in L.
Figure 5:
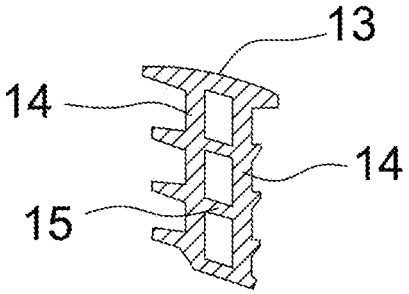
FIG. 5 corresponds to a sectional view of the elastic profile in T.
Figure 6:
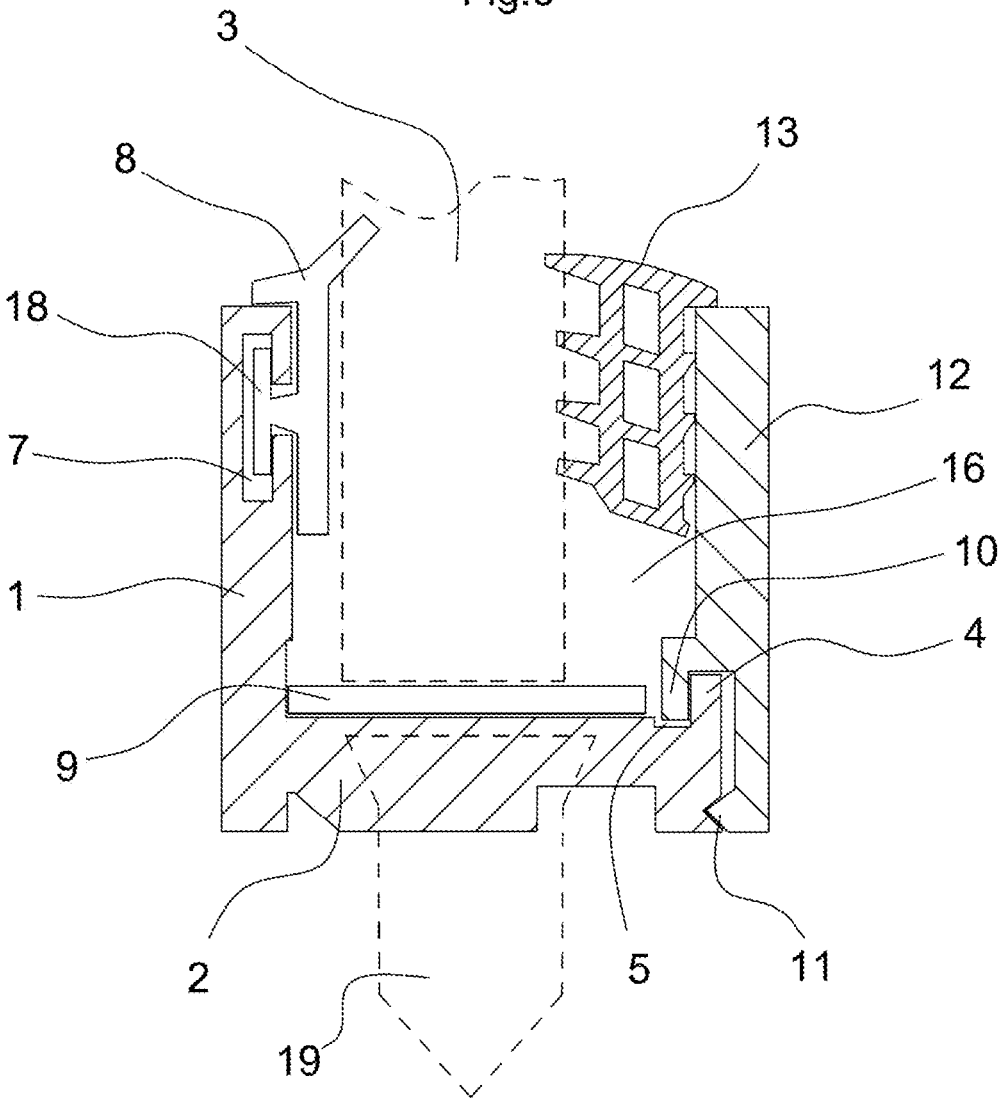
FIG. 6 corresponds to a view of the new structural element for securing glass partitions in a version without the new elastic profile in L.

1 support metal profile
2 seating area of the glass
3 glass
4 vertical rib
5 rectangular groove
6 V groove
7 T groove
8 rubber gasket
9 elastic strip
10 L-shaped protrusion
11 V rib
12 closing metal profile
13 Elastic profile in T
14 parallel walls
15 inclined planes
16 gap
17 elastic profile in L
18 rib with a T-section
19 fixings screws

DESCRIPTION OF A PRACTICAL EXAMPLE

According to the drawings, the new structural element for fixing glass partitions and separations in work spaces consists of three basic parts:

A support metal profile (1) with a general L-shaped structure in which the glass (3) is inserted, whose horizontal section constitutes the seating area of the glass (2), is thicker than the vertical section and has at the end a vertical rib (4) preceded by rectangular groove (5), and a groove with V-section (6) located in the lower area of the side face of this section.

The metal support profile also comprises a rubber gasket (8) and an elastic strip (9) separating the glass (3) from the metal body of the profile.

A closing metal profile (12) with a rectangular general structure, which has elements:

An L-shaped protrusion (10) operatively engageable on the vertical rib (4) and whose end is inserted in the rectangular section groove (5).

A rib with a V-section (11) arranged laterally at the end of the piece, operatively interlocking in the V-shaped groove (6) of the metal support profile.

An elastic profile in T (13) whose vertical section is constituted by two parallel walls (14) crossed by several inclined planes (15) that protrude from the sides and which is operatively inserted under pressure, closing the gap (16) between the glass and the closing metal profile.

According to the example of FIG. 1, the invention has an elastic profile in L (17) that covers the entire interior of the support metal profile (1) and is mechanically coupled to it by means of a rib with a T-section (18) that engages the T-groove (7) of the support metal profile (1) so that the vertical section covers the vertical internal zone of the support profile and the horizontal section extends through the seating area of the glass (2).

The support metal profile incorporates a plurality of perforations through which the fixing screws (19) are inserted.

The invention claimed is:

1. A structural element to secure a glass partition, the structural element comprising:

a) a metal support having a horizontal section and a vertical section forming an L-shape, the horizontal section of the metal support is adapted to be placed directly against a floor, the glass partition is adapted to rest on the horizontal section of the metal support, the metal support including:

a vertical rib located at an outer end of the horizontal section of the metal support;

a rectangular groove at the outer end of the horizontal section of the metal support and that is located adjacent to the vertical rib;

a V-shaped groove located at the outer end of the horizontal section of the metal support and opposite to the vertical rib;

a T-shaped groove located at an outer end of the vertical section of the metal support;

a rubber gasket having a T-shaped section to be inserted into the T-shaped groove of the vertical section of the metal support, the rubber gasket adapted to separate the glass partition from the vertical section of the metal support;

an elastic strip located on the horizontal section of the metal support;

b) a closing metal plate including:

a first end including an L-shaped protrusion and a V-shaped rib, the L-shaped protrusion having a short section that operatively connects to the vertical rib of the horizontal section of the metal support and a long section that engages the rectangular groove of the horizontal section of the metal support, the short section being shorter than the long section, the V-shaped rib operatively connects to the V-shaped groove of the horizontal section of the metal support;

c) a T-shaped elastic member including a vertical section and a horizontal section, the vertical section of the T-shaped elastic member including parallel walls crossed by a plurality of inclined ribs connecting the parallel walls; and wherein the T-shaped elastic member is placed on a second end of the closing metal plate and is adapted to separate the glass partition from the closing metal plate.

2. The structural element according to claim 1, wherein the T-shaped elastic member exerts a force against the closing metal plate that is proportional to a compression of the vertical section of the T-shaped elastic member and a bending of the inclined ribs, which makes the closing metal plate pivot on the vertical rib, propitiating a lever effect that forces an interlocking of the V-shaped rib in the V-shaped groove of the metal support.

3. The structural according to claim 1, wherein the rubber gasket has an L-shape with a T-shaped section to be inserted into the T-shaped groove of the vertical section of the metal support.

4. The structural according to claim 1, wherein the horizontal section of the metal support has a thickness greater than a thickness of the vertical section of the metal support.

5. The structural according to claim 1, wherein the metal support has a plurality of perforations adapted to receive fasteners.

* * * * *